US005307845A

United States Patent [19]

Vanrobaeys et al.

[11] Patent Number: 5,307,845

[45] Date of Patent: May 3, 1994

[54] SPLIT LOOM INCLUDING A SELVAGE-FORMER MOUNTED IN A REMOVABLE LOOM PART

[75] Inventors: Serge Vanrobaeys, Ieper; Kurt Slosse, Boezinge; Patrick Glorie, Ieper, all of Belgium

[73] Assignee: Picanol N.V., Belgium

[21] Appl. No.: 41,465

[22] Filed: Apr. 2, 1993

[30] Foreign Application Priority Data

Apr. 15, 1992 [BE] Belgium ..... 09200340

[51] Int. Cl.[5] ..... D03D 49/02; D03D 47/40

[52] U.S. Cl. ..... 139/1 R; 139/54; 139/430; 139/1 E

[58] Field of Search ..... 139/54, 1 R, 430, 1 E, 139/82

[56] References Cited

U.S. PATENT DOCUMENTS

| | | | |
|---|---|---|---|
| 3,320,978 | 5/1967 | Kobayashi et al. . | |
| 4,193,427 | 3/1980 | Shindo et al. | 139/54 |
| 4,421,141 | 12/1983 | Brouwer | 139/54 |
| 4,566,566 | 1/1986 | Vuillet | 139/1 EX |

FOREIGN PATENT DOCUMENTS

| | | | |
|---|---|---|---|
| 0296115 | 12/1988 | European Pat. Off. | 139/1 R |
| 2264039 | 10/1990 | Japan | 139/1 R |
| 668608 | 1/1989 | Switzerland . | |

*Primary Examiner*—Andrew M. Falik
*Attorney, Agent, or Firm*—Bacon & Thomas

[57] ABSTRACT

A split loom with a stationary loom part and a removable loom part includes selvage-formers mounted in the removable loom part, at least one selvage-former being driven by a shaft entering the loom and also mounted on the removable loom part, the shaft being connectable by a separable clutch to a drive shaft mounted on the stationary loom part.

7 Claims, 3 Drawing Sheets

21
26
27
29
38
28
35
39
31
41
32
40
18
33
30
25
IV
V
34
36
37
2
17

SPLIT LOOM INCLUDING A SELVAGE-FORMER MOUNTED IN A REMOVABLE LOOM PART

BACKGROUND OF THE INVENTION

1. Field of the Invention

The invention concerns a weaving loom which includes a stationary part containing a harness drive and a removable part containing a warp-beam bearing.

2. Description of Related Art

It is known from Swiss patent publication 68 608 A5 to split a loom into a stationary loom part and a removable loom part. The stationary loom part includes a harness drive for harnesses which are held in place in the removable loom part so that, after being detached from the harness drive, they can be removed along with the removable loom part.

It is further known from U.S. Pat. No. 3,320,978 to equip a loom with selvage formers and to equip the selvage formers with a rotary drive.

SUMMARY OF THE INVENTION

It is an objective of the invention to equip a split loom with selvage formers so that the selvage formers and their rotary drive do not hamper the removal of the removable loom part or the re-assembly of the removable loom part to the stationary loom part.

This objective is achieved by mounting selvage formers in the removable loom part such that at least one of the selvage formers is driven by a shaft extending essentially transversely to the warps, the shaft being held in the removable loom part and connectable by a clutch to a drive shaft mounted in the stationary loom part.

This design makes it possible to mount the rotational drive for the selvage formers in the stationary loom part, the drive being taken, for example, off the batten-drive or the harness-drive or being powered by its own motor, while the selvage-formers can be mounted in front of the harnesses so that they do not hamper dis-assembly or re-assembly of the removable loom part.

In a preferred embodiment of the invention, at least one of the selvage formers is mounted in adjustable manner in the width-direction of the loom. As a result, different widths of fabrics can be produced on the loom without interference with disassembly or reassembly of the removable loom part by the selvage formers, at least one of which is mounted near the center of the loom.

Further features and advantages of the invention are elucidated in the following description of the embodiment shown in the drawings.

DETAILED DESCRIPTION OF THE PREFERRED EMBODIMENT

Figure 1:
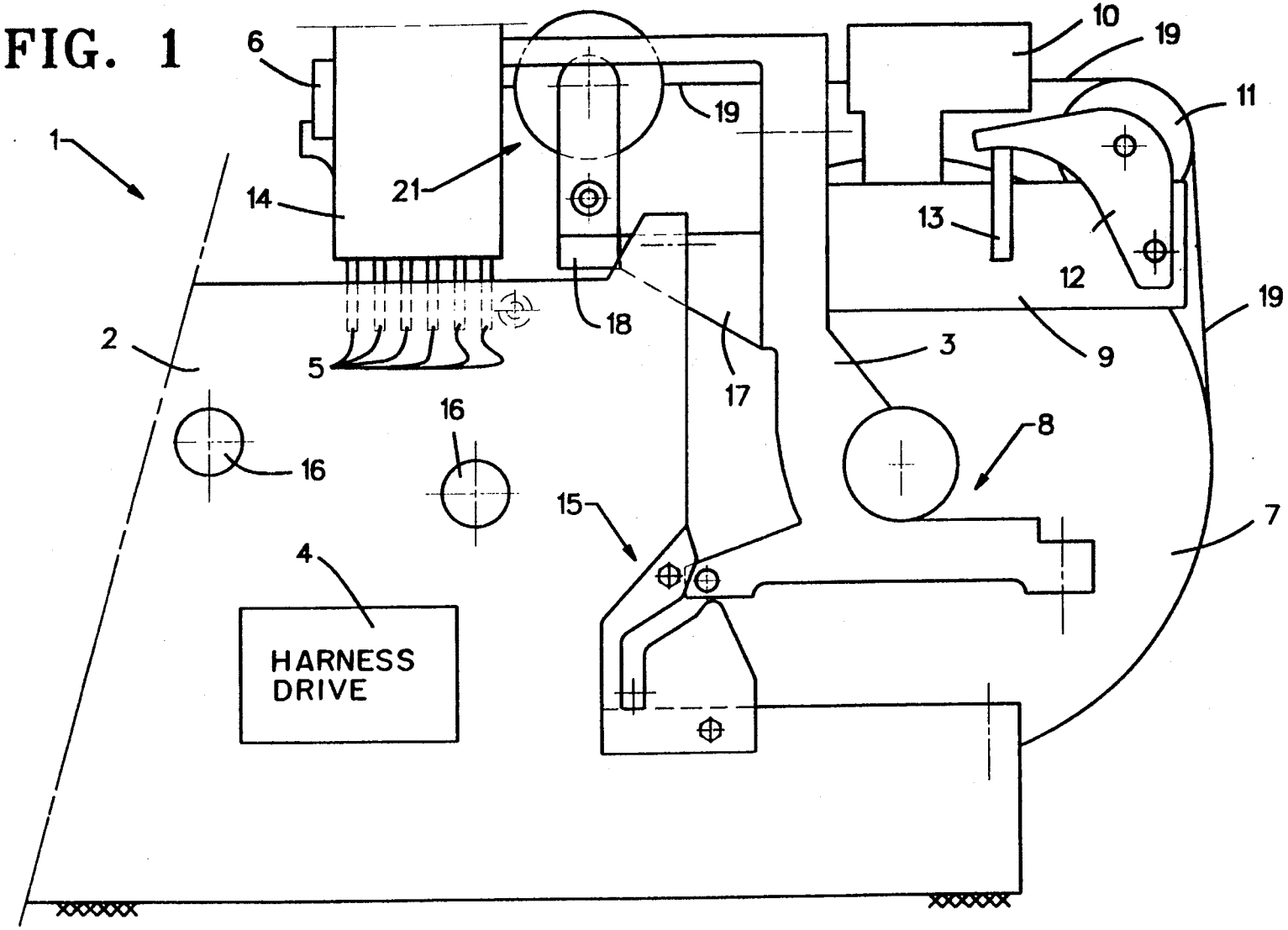
FIG. 1 is a schematic side view of a split loom during dis-assembly or re-assembly of the removable loom part.
Figure 2:
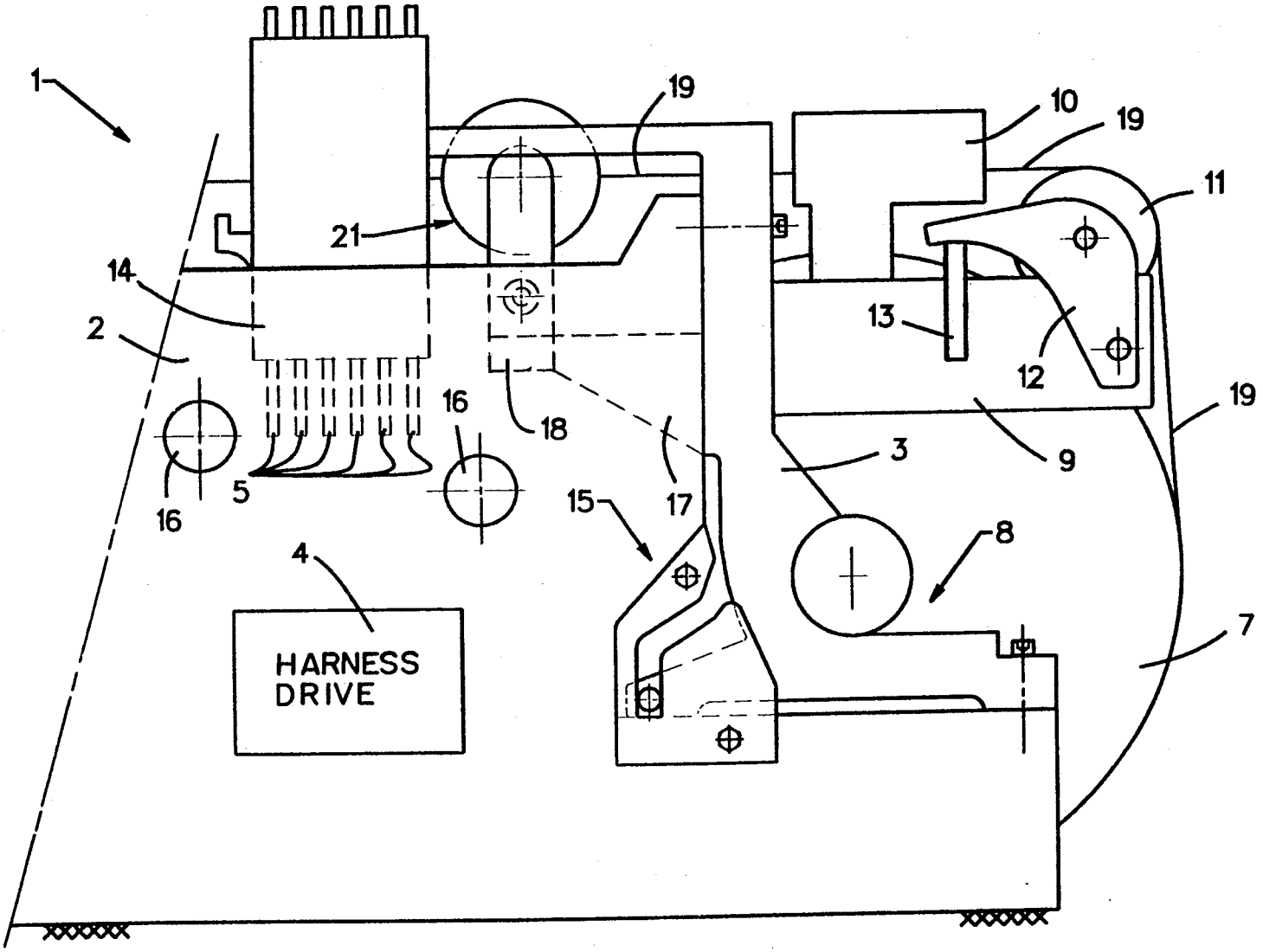
FIG. 2 is a side view of the loom in the assembled state.

The loom shown in FIGS. 1 and 2 consists of a first, stationary loom part 2 and of a second, removable loom part 3. The stationary loom part 2 includes a batten drive (not shown), a cloth roll-up system (not shown), a warp-beam drive (not shown) and a schematically indicated harness drive 4.

When the harnesses 5 are detached from the harness drive 4, the reed 6 is detached from its drive, and the warp-beam 7 is separated from its drive, the harnesses, reed, and warp-beam can each be removed together with the removable loom part 3. The loom part 3 contains a bearing 8 for the warp-beam and height-adjustable support arms 9 for a warp stop-motion 10 and a back-beam 11. The back-beam 11 is held in place by rockers 12 pivotably supported on the support arms 9 and resting against springs 13 affixed to the support arm 9. The removable loom part 3 also includes harness guides 14 in a support frame. A fastener for the reed 6 is mounted on the harness guides 14.

The stationary loom part 2 and the removable loom part 3 are equipped with mutually engaging guides 15 that during disassembly or reassembly provide constrained guidance so that the harnesses 5 in particular can be mounted or removed with a predetermined motion in order to prevent them from colliding with components of the stationary loom part 3, for instance with the cross-beams 16 mounted between the side parts of the loom part 2. The warps 19 run from warp-beam 7 over the back-beam 11 through the warp stop-motion 10 toward the harnesses 5 and the reed 6.

Figures 3, 4, 5:
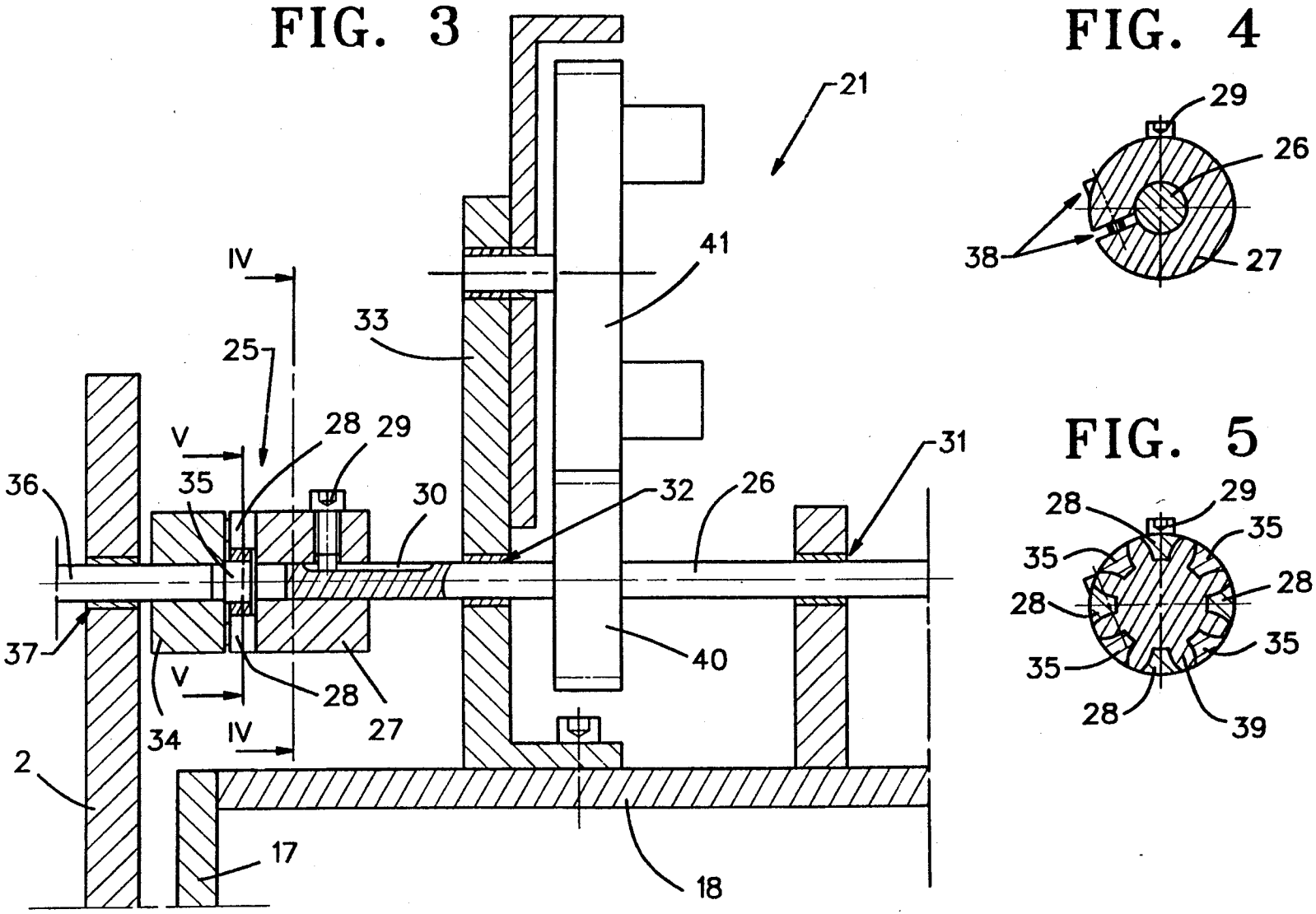
FIG. 3 is a partial section of the assembled loom near a selvage former and its drive.
FIG. 4 is a section along line IV—IV of FIG. 3.
FIG. 5 is a section along line V—V of FIG. 3.

The removable loom part 3 is equipped at its side parts with affixed arms 17 which, in the assembled state of the two loom parts 2 and 3 as shown by FIG. 2, enter the stationary loom part 2. The arms 17 support a cross-beam 18. Two selvage formers 21 are mounted on the cross-beam 18. Such selvage formers 21 are known per se. Illustratively, their design may be that disclosed in U.S. Pat. No. 3,320,978. As shown by FIGS. 3 and 4, the selvage formers 21 include a gear 41 mounted in a bracket 33 affixed to the cross-beam 18. The gear 41 is driven by a meshing gear 40 mounted on a shaft 26. The shaft 26 is supported in bracket 33 by means of a bearing 32 and by means of another or several bearings 31 resting on the cross-beam 18.

The shaft 26 is connected by a separable clutch 25 to a drive shaft 36 supported by a bearing 37 in a side part of the stationary loom part 2. In a manner not shown, the drive shaft 36 is driven by a batten drive or a harness drive. It is also possible to allocate to the drive shaft 36 a drive motor of its own which is synchronous with the main motor of the loom.

The separable clutch is preferably a positively-locking coupling rather than a friction coupling. One clutch part 34 is mounted to rotate with the drive shaft 36 and including teeth 35 which engage teeth 28 of a clutch part 27. The clutch part 27 is axially displaceable on the shaft 26 so that the clutch 25 can be separated, and is connected to rotate with shaft 26 by means of, in the illustrated embodiment, a screw 29 which enters a longitudinal slot 30 of the shaft 26. As a result of the engagement between screw 29 and slot 30, which prevents relative rotation between screw 29 and slot 30, the relative angular position between the shaft 26 and the clutch part 27 is maintained even when the clutch part 27 is being axially displaced. The clutch part 27 is also fitted with a longitudinal slot for receiving a tightening screw 38 which, when tightened, clamps the clutch part 27 onto the shaft 26.

As shown in FIG. 5, a preferably elastic, plastic gear-shaped intermediate part 39 is mounted between the end-face teeth 28 of the clutch part 27 and the corresponding end-face teeth 35 of the clutch part 34. This intermediate part is rigidly joined to the teeth 28 of the clutch part 27, for example by bonding.

The clutch 25 is separated when disassembling the removable loom part 3. For that purpose, the tightening screw 38 is loosened and as a result the clutch part 27 can be displaced along the shaft 26 until the teeth 28 and 35 are mutually apart. Preferably, the tightening screw 38 is slightly tightened thereupon in order to prevent unintentional shifting of the clutch part 27 along the shaft 26. When the removable loom part 3 is reassembled, the clutch part—if called for after loosening the tightening screw 38—is again shifted along the shaft 26 until the teeth 28 and 35 of the two clutch parts 27 and 34 again engage one another after which the tightening screw 38 is tightened. Because the clutch part 27 remains connected against rotation relative to the shaft 26 even after the clutch 25 has been separated, it is possible to reestablish in simple manner the synchronization between the selvage former 21 and the drive shaft 36. Illustratively, the two clutch parts 27 and 34 may comprise markings on each. This makes it possible to carry out the time of crossing of the yarns of the selvage former 21 at a given point in the weaving cycle, the time of crossing being retained following reassembly of the loom part 3. The same effect also can be achieved by arranging the teeth 28 and 35 of the clutch parts 27 and 34 in such a way that they can engage only when the shaft 26 and the drive shaft 36 subtend a defined angle between them.

In order to be able to manufacture fabrics of different widths while using the selvage formers, the support 33 together with the selvage former 21 can be mounted at various positions on the cross-beam 18 by displacing the support 33 and the gear 40 on the shaft 26.

As a rule, the design is such that the shaft 26, which essentially runs parallel to the cross-beam 18, extends across the entire width of the loom and drives the two selvage formers 21. As regards looms in which the maximum possible weaving width is not is not used on one side of the fabric, it will suffice to provide a selvage former affixable in different positions only on that side, whereas the opposite side selvage former may be mounted in a single non-adjustable position. In that event, the shaft 26 need not extend across the entire loom width, but instead the length of the shaft 26 may be restricted to the range in which the corresponding selvage-former 21 driven by the shaft 26 is adjustably positioned.

It will be appreciated by those skilled in the art that additional variations of the preferred embodiment are possible. For example, the above-described arrangement of the selvage formers 21 also applies to Jacquard looms. This and other such modifications are all intended to be included within the scope of the invention and, thus, the above description and accompanying illustrations are not to be taken as limiting the invention, but rather the invention should be defined solely by the appended claims.

We claim:

1. In a split loom which includes a stationary loom part, and a removable loom part containing a warp-beam bearing, the improvement comprising a selvage-former mounted in the removable loom part, means including a first shaft extending in a loom width direction for driving said selvage-former to form a selvage, means for affixing the shaft to the removable loom part, and means including a separable clutch for separably connecting the shaft to a second shaft mounted in the stationary loom part when the removable loom part is assembled to the stationary loom part.

2. An improvement as claimed in claim 1, further comprising means for mounting the selvage-former to be adjustable in the loom width direction.

3. An improvement as claimed in claim 1, wherein the removable loom part further comprises a cross-beam which enters the stationary loom part when the removable and stationary loom parts are assembled, said cross-beam forming means for supporting shaft bearings and for supporting a selvage-former support.

4. An improvement as claimed in claim 3, further comprising means for affixing the selvage-former support in several optional positions along the width of the loom.

5. An improvement as claimed in claim 1, further comprising means for positively locking together first and second separable parts of said clutch, said first and second separable parts being respectively connected to rotate with the first and second shafts when said removable part is assembled to said stationary part.

6. An improvement as claimed in claim 1, wherein the separable clutch includes a first part, a second part mounted on the second shaft, and means for mounting the first part to be axially displaceable on the first shaft in order to bring the first part into and out of engagement with said second part.

7. An improvement as claimed in claim 6, further comprising means for allowing the first and second clutch parts to engage each other only at predetermined angular positions.

* * * * *